US012133563B2

(12) United States Patent
Young et al.

(10) Patent No.: US 12,133,563 B2
(45) Date of Patent: Nov. 5, 2024

(54) UPPER BODY GARMENT

(71) Applicant: Spanx, LLC, Atlanta, GA (US)

(72) Inventors: Bethany Young, Salmon Arm (CA); Kristin Tansey, Atlanta, GA (US); Chloe Wieser, Atlanta, GA (US)

(73) Assignee: Spanx, LLC, Atlanta, GA (US)

( * ) Notice: Subject to any disclaimer, the term of this patent is extended or adjusted under 35 U.S.C. 154(b) by 0 days.

(21) Appl. No.: 17/493,376

(22) Filed: Oct. 4, 2021

(65) Prior Publication Data

US 2022/0361593 A1 Nov. 17, 2022

Related U.S. Application Data

(60) Provisional application No. 63/189,480, filed on May 17, 2021.

(51) Int. Cl.
*A41C 3/00* (2006.01)

(52) U.S. Cl.
CPC ..... *A41C 3/0057* (2013.01); *A41C 3/0021* (2013.01)

(58) Field of Classification Search
None
See application file for complete search history.

(56) References Cited

U.S. PATENT DOCUMENTS 3,699,971 A * 10/1972 Hittel ..... A41C 3/0028 450/67
3,746,008 A * 7/1973 LoCascio ..... A41C 3/00 450/74
4,217,905 A * 8/1980 Atwater ..... A41C 3/0057 450/74
4,254,777 A * 3/1981 Johnston ..... A41C 3/0057 450/41
4,289,137 A * 9/1981 Dell ..... A41C 3/02 2/912
4,340,064 A * 7/1982 Vale ..... A41C 3/0057 450/72
4,583,544 A * 4/1986 Flanagan ..... A41C 3/0057 2/67
4,607,640 A * 8/1986 McCusker ..... A41C 3/0057 450/1
4,655,224 A * 4/1987 Stern ..... A41C 3/00 450/67
5,152,741 A * 10/1992 Farnio ..... A61F 13/145 602/61
D388,587 S * 1/1998 Magidson ..... D2/706
6,125,664 A * 10/2000 Browder, Jr. ..... A41C 3/0014 66/196
6,572,437 B1 * 6/2003 Waitz ..... A41C 3/00 450/1
7,513,817 B2 * 4/2009 Cheng ..... A41D 27/24 2/274
8,465,341 B2 * 6/2013 Shashy ..... A41C 3/0057 450/39

(Continued)

*Primary Examiner* — Jocelyn Bravo
(74) *Attorney, Agent, or Firm* — Meunier Carlin & Curfman LLC

(57) ABSTRACT

The disclosed garments are designed to address the need for athletic upper body garments that do not create or highlight bulging in the wearer's body. These garments comprise an advantageous bottom edge that is defined by a fold crease rather than an elastic band. Methods of making the garments are also disclosed herein.

20 Claims, 4 Drawing Sheets

(56) References Cited

U.S. PATENT DOCUMENTS 8,915,764 B2 * 12/2014 Scott ..... A41C 3/12 450/53
8,925,114 B2 * 1/2015 Jackson ..... A41C 3/08 450/37
9,210,955 B2 * 12/2015 Dandapure ..... A41C 5/005
9,320,305 B1 * 4/2016 Berger ..... A41C 3/08
9,480,287 B2 * 11/2016 Black ..... A41C 3/0057
10,179,960 B2 * 1/2019 Diaz ..... A41C 3/0057
10,206,436 B1 * 2/2019 Wooley-Scheiman ..... A41C 3/0057
10,231,492 B1 * 3/2019 Bastug ..... A41C 3/10
10,448,679 B1 * 10/2019 Roddis ..... A41C 3/0057
10,660,377 B2 * 5/2020 Randall ..... A41C 3/14
10,786,016 B2 * 9/2020 Caden ..... A61F 13/14
10,905,172 B2 * 2/2021 Fontaine ..... A41C 3/0057
11,044,954 B2 * 6/2021 Misseldine ..... A41C 3/0057
11,284,648 B2 * 3/2022 Carlino ..... A41C 3/0085
11,317,657 B2 * 5/2022 Fontaine ..... A41D 31/02
11,523,640 B2 * 12/2022 Wallace ..... A41C 3/0057
2001/0019933 A1 * 9/2001 Wagner ..... A41C 3/0057 450/37
2002/0022433 A1 * 2/2002 Yeung ..... A41C 3/0057 450/93
2003/0096557 A1 * 5/2003 Waitz ..... A41C 3/00 450/1
2003/0217407 A1 * 11/2003 Andrews-Jones ..... A41B 9/001 2/400
2004/0003629 A1 * 1/2004 Mitchell ..... D04B 1/02 66/179
2004/0014394 A1 * 1/2004 Mitchell ..... A41C 5/00 450/65
2006/0025039 A1 * 2/2006 Barbour ..... A41D 15/005 450/1
2006/0105673 A1 * 5/2006 Lau ..... A41C 5/005 450/39
2006/0240743 A1 * 10/2006 Mitchell ..... A41C 5/00 450/1
2006/0252346 A1 * 11/2006 Reinisch ..... A41C 3/0028 450/86
2009/0098803 A1 * 4/2009 Reinisch ..... A41C 3/0014 450/86
2010/0005569 A1 * 1/2010 Sanders ..... A41C 3/0057 2/400
2010/0035512 A1 * 2/2010 Jimenez ..... A41C 3/0021 450/80
2011/0086577 A1 * 4/2011 Fleischman-Ament ..... A41C 3/0064 450/56
2012/0122370 A1 * 5/2012 Heath ..... A41C 3/0057 450/80
2012/0122371 A1 * 5/2012 Reinisch ..... A41C 3/0057 450/93
2013/0084777 A1 * 4/2013 Starr ..... A41C 3/0057 450/86
2013/0189900 A1 * 7/2013 Bloch Marco ..... A41C 3/00 450/93
2014/0115748 A1 * 5/2014 Berns ..... A43B 1/10 2/69
2015/0056890 A1 * 2/2015 Black ..... A41C 3/146 450/86
2015/0342267 A1 * 12/2015 Lau ..... A41C 3/0014 450/92
2015/0374042 A1 * 12/2015 Abbott ..... A41C 3/12 2/400
2016/0044971 A1 * 2/2016 Randall ..... A41C 3/142 450/39
2016/0353810 A1 * 12/2016 Barnes ..... A41C 5/00
2017/0290376 A1 * 10/2017 Maheshwari ..... D04B 21/207
2017/0332704 A1 * 11/2017 Fontaine ..... A41F 15/002
2017/0360118 A1 * 12/2017 Randall ..... A41C 3/02
2018/0077972 A1 * 3/2018 Hinnershitz ..... A41D 1/215
2018/0085620 A1 * 3/2018 Feldman ..... A41C 3/0057
2018/0092408 A1 * 4/2018 Hensel ..... A41C 3/04
2018/0279692 A1 * 10/2018 Witek ..... A41C 3/0057
2019/0174841 A1 * 6/2019 Bastug ..... A41C 3/0007
2020/0297042 A1 * 9/2020 Carlino ..... A41C 3/08
2020/0323278 A1 * 10/2020 Roddis ..... A41C 3/005
2021/0068473 A1 * 3/2021 Wallace ..... A41C 3/0057
2021/0106075 A1 * 4/2021 Misseldine ..... A41C 3/0021
2021/0186126 A1 * 6/2021 Horsell ..... A41C 3/0057
2021/0219628 A1 * 7/2021 Rendone ..... A41C 3/12
2021/0251306 A1 * 8/2021 Fontaine ..... A41D 7/00
2021/0274856 A1 * 9/2021 Blythe ..... A41B 9/14
2022/0039485 A1 * 2/2022 Pennington ..... A41C 3/0057
2022/0369728 A1 * 11/2022 Lee ..... A41C 3/0057

* cited by examiner

UPPER BODY GARMENT

CROSS-REFERENCE TO RELATED APPLICATIONS

This application is a United States Non-Provisional Application, which claims benefit of U.S. Provisional Application No. 63/189,480, filed May 17, 2021, which is hereby incorporated herein by reference in its entirety.

BACKGROUND

Typical athletic or athleisure garments are designed to fit tightly against and uniformly compress the wearer's body to hold aspects of the wearer's body in place and prevent slippage of the garment on the wearer's body during use particularly during high-impact exercise. Athletic upper body garments, such as sports bras, camisoles, or tank tops, are particularly designed to compress the wearer's breast tissue to the chest and hold the breast tissue in place during exercise. They often further include an elastic or stiff band positioned below the wearer's breast tissue to provide support to the breast tissue or upper body tissue in the superior direction. These garments commonly create or highlight bulging in the wearer's body on either side of the band and along the edges of the garment.

Therefore, there exists a need for fashionable upper body garments that provide adequate compression and support to the wearer's body during exercise while creating or maintaining a smooth profile of the wearer's body.

BRIEF SUMMARY

In one aspect, an upper body garment having an inner surface and an outer surface is disclosed. In some aspects, the upper body garment comprises a front panel comprising a breast support region. In still further aspects, the upper body garment comprises a back panel configured to cover at least a portion of a wearer's back. In such exemplary aspects, the back panel is coupled to the front panel. Yet, in other aspects, the front panel comprises a front inner layer and a front outer layer. In still further aspects, the back panel comprises a back inner layer and a back outer layer. In yet other aspects, each of the front and the back panels extend up to at least a lowest edge of the wearer's thorax. In yet still further aspects, a portion of each of the front and back outer layers circumferentially folds upward and inward onto the inner surface of the upper body garment, thereby forming an upward and inward folded portion. In such exemplary and unlimiting aspects, the bottom edge of the garment is defined by a fold crease. In yet still further aspects, the upper body garment as disclosed herein is configured to substantially limit movement of the wearer's breast tissue during athletic activity.

Also disclosed herein are methods of making the upper body garments.

Providing an upward and inward folded portion has several advantages over conventional bottom edges comprising elastic or stiff bands. For example, in some aspects, the upward and inward folded portion and fold crease bottom edge allow the wearer to freely move or twist the waist during exercise without restriction or irritation. Yet, in other aspects, the upward and inward folded portion and fold crease bottom edge allow the wearer to exercise without slippage of the garment. In still further aspects, the upward and inward folded portion and fold crease bottom edge create and maintains a smooth profile of the wearer's torso.

In still further aspects, the upward and inward folded portion and fold crease bottom edge are less visible under clothing than a bottom edge comprising an elastic or stiff band. Yet, in still further aspects, the length of the upward and inward folded portion can be adjusted, allowing for variations in garment length while maintaining support for the wearer's breast tissue. In still further aspects, the upward and inward folded portion and fold crease bottom edge allow for more fit flexibility within the constraint of alpha sizing.

In addition to the aspects and aspects described above, further aspects and aspects will become apparent by reference to the drawings and study of the following detailed description. Additional advantages will be set forth in part in the description which follows, and in part will be obvious from the description or can be learned by practice of the aspects described below. The advantages described below will be realized and attained by means of the disclosed structures, compositions, materials, methods, and combinations thereof, particularly pointed out in the appended claims. It is to be understood that both the foregoing general description and the following detailed description are exemplary and explanatory only and are not restrictive of the invention, as claimed.

DETAILED DESCRIPTION

Figure 1:
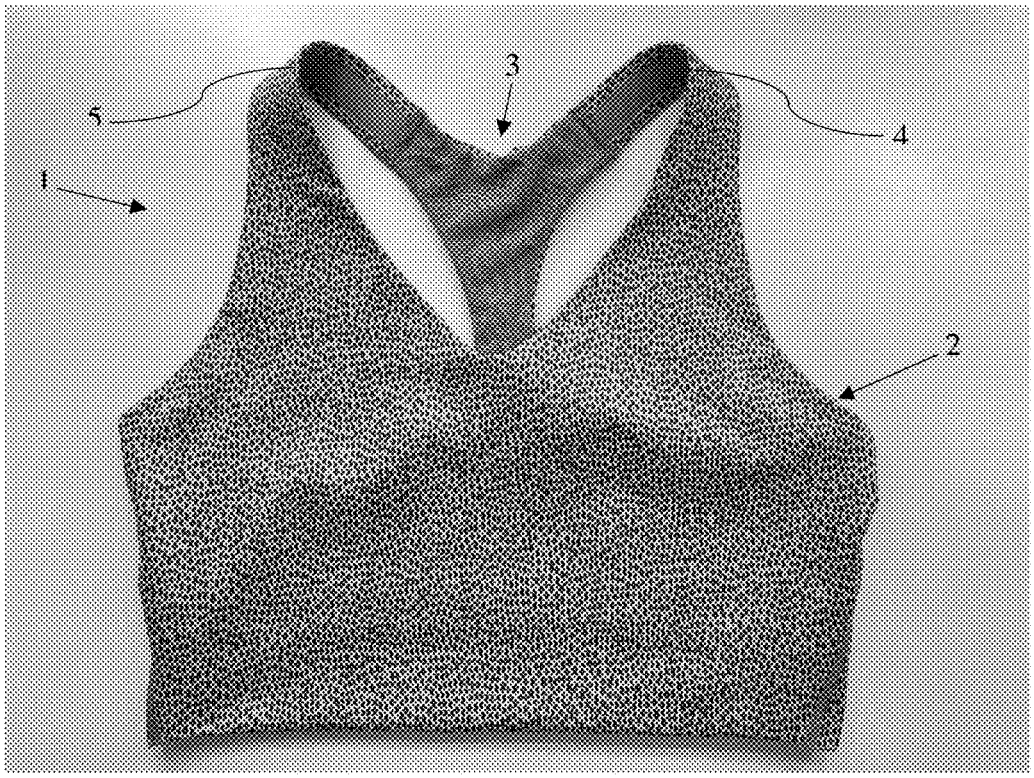
FIG. 1 illustrates a front view of an aspect of an upper body garment.

The present invention can be understood more readily by reference to the following detailed description, examples, drawings, and claims, and their previous and following description. However, before the present garments, articles, systems, and/or methods are disclosed and described, it is to be understood that this disclosure is not limited to the specific or exemplary aspects of garments, articles, systems, and/or methods disclosed unless otherwise specified, as such can, of course, vary. Instead, the present disclosure is directed toward all novel and nonobvious features and aspects of the various disclosed aspects, alone and in various combinations and sub-combinations with one another. The disclosed methods, systems, and apparatus are not limited to any specific aspect, feature, or a combination thereof, nor do the disclosed methods, systems, and apparatus require that any one or more specific advantages be present or problems be solved.

The following description of the invention is provided as an enabling teaching of the invention in its best, currently known aspect. To this end, those skilled in the relevant art will recognize and appreciate that many changes can be made to the various aspects of the invention described herein while still obtaining the beneficial results of the present invention. It will also be apparent that some of the desired benefits of the present invention can be obtained by selecting some of the features of the present invention without utilizing other features. Accordingly, those of ordinary skill in the pertinent art will recognize that many modifications and adaptations to the present invention are possible and may even be desirable in certain circumstances and are a part of the present invention. Thus, the following description is again provided as illustrative of the principles of the present invention and not in limitation thereof.

Features, integers, characteristics, or groups described in conjunction with a particular aspect or example of the invention are to be understood to be applicable to any other aspect or example described herein unless incompatible therewith. All of the features disclosed in this specification (including any accompanying claims, abstract, and drawings) and/or all of the steps of any method or process so disclosed may be combined in any combination, except combinations where at least some of such features and/or steps are mutually exclusive. The invention is not restricted to the details of any aspects. The invention extends to any novel one, or any novel combination, of the features disclosed in this specification (including any accompanying claims, abstract, and drawings), or to any novel one, or any novel combination, of the steps of any method or process so disclosed.

It should be appreciated that any patent, publication, or other disclosure material, in whole or in part, that is said to be incorporated by reference herein is incorporated herein only to the extent that the incorporated material does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

As used herein, the terms "optional" or "optionally" means that the subsequently described event or circumstance can or cannot occur and that the description includes instances where said event or circumstance occurs and instances where it does not.

It is appreciated that certain features of the disclosure, which are, for clarity, described in the context of separate aspects, can also be provided in combination in a single aspect. Conversely, various features of the disclosure, which are, for brevity, described in the context of a single aspect, can also be provided separately or in any suitable subcombination.

As used in the description and the appended claims, the singular forms "a," "an," and "the" include plural referents unless the context clearly dictates otherwise. Thus, for example, a reference to "a panel" includes two or more such panels, reference to "a band" includes two or more such bands and the like.

Ranges may be expressed herein as from "about" one particular value and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint and independently of the other endpoint.

It is also to be understood that the terminology used herein is for the purpose of describing particular aspects only and is not intended to be limiting. As used in the specification and in the claims, the term "comprising" can include the aspects "consisting of" and "consisting essentially of." Unless defined otherwise, all technical and scientific terms used herein have the same meaning as commonly understood by one of ordinary skill in the art to which this invention belongs. In this specification and in the claims, which follow, reference will be made to a number of terms that shall be defined herein.

For the terms "for example" and "such as," and grammatical equivalences thereof, the phrase "and without limitation" is understood to follow unless explicitly stated otherwise.

It will be understood that when an element is referred to as being "connected" or "coupled" to another element, it can be directly connected or coupled to the other element, or intervening elements may be present. In contrast, when an element is referred to as being "directly connected" or "directly coupled" to another element, there are no intervening elements present. Other words used to describe the relationship between elements or layers should be interpreted in a like fashion (e.g., "between" versus "directly between," "adjacent" versus "directly adjacent," "on" versus "directly on"). As used herein, the term "and/or" includes any and all combinations of one or more of the associated listed items.

It will be understood that, although the terms "first," "second," etc., may be used herein to describe various elements, components, regions, layers and/or sections. These elements, components, regions, layers, and/or sections should not be limited by these terms. These terms are only used to distinguish one element, component, region, layer, or section from another element, component, region, layer, or section. Thus, a first element, component, region, layer, or section discussed below could be termed a second element, component, region, layer, or section without departing from the teachings of example aspects.

As used herein, the term "substantially" means that the subsequently described event or circumstance completely occurs or that the subsequently described event or circumstance generally, typically, or approximately occurs. Still further, the term "substantially" can in some aspects refer to at least about 80%, at least about 85%, at least about 90%, at least about 91%, at least about 92%, at least about 93%, at least about 94%, at least about 95%, at least about 96%, at least about 97%, at least about 98%, at least about 99%, or about 100% of the stated property, component, composition, or other condition for which substantially is used to characterize or otherwise quantify an amount.

While aspects of the present invention can be described and claimed in a particular statutory class, such as the system statutory class, this is for convenience only, and one of ordinary skill in the art will understand that each aspect of the present invention can be described and claimed in any statutory class. Unless otherwise expressly stated, it is in no way intended that any method or aspect set forth herein be construed as requiring that its steps be performed in a specific order. Accordingly, where a method claim does not specifically state in the claims or descriptions that the steps are to be limited to a specific order, it is in no way intended that an order be inferred in any respect. This holds for any possible non-express basis for interpretation, including matters of logic with respect to arrangement of steps or operational flow, plain meaning derived from grammatical organization or punctuation, or the number or type of aspects described in the specification.

The present invention may be understood more readily by reference to the following detailed description of various aspects of the invention and the examples included therein and to the Figures and their previous and following description.

This description below refers to certain aspects of the garment relative to other aspects of the garment or to the body of a wearer. As used herein, superior indicates a direction that is closer to the wearer's head. Inferior indicates a direction that is closer to the wearer's feet. Upward, upper, or uppermost indicates a superior direction or toward a wearer's head. Downward, lower, or lowermost indicates an inferior direction or toward a wearer's feet. The longitudinal direction refers to an axis extending between the superior and inferior edges of the garment or between the wearer's head and feet. Lateral indicates a positioning that is closer to the sides of the wearer. Medial indicates a positioning that is farther from the sides of the wearer. The terms right and left are in reference to the wearer's body. Some of the figures may include the letters R and L as right and left directional indicators.

There exists a need for athletic upper body garments that are supportive during high-impact exercise and avoid the appearance of bulging around compressive areas of the garment. Elastic or stiff bands are typically positioned at the lower edges of upper body garments, such as sports bras, to provide support for the wearer's breast tissue or to provide friction, reducing slippage of the garment. Such bands commonly create and highlight unwanted bulging in the wearer's body on either side of the band. The upper body garment disclosed herein is designed to address the need for fashionable upper body garments that provide adequate compression and support to the wearer's body during exercise while creating or maintaining a smooth profile of the wearer's body.

In certain aspects, described herein is an upper body garment comprising an inner surface and an outer surface. In some aspects, the upper body garment comprises a front panel coupled to a back panel. In yet other aspects, the front panel comprises a front inner layer and a front outer layer, and the back panel comprises a back inner layer and a back outer layer. In still further aspects, the front and back outer layers circumferentially fold upward and inward onto the inner surface of the upper body garment, thereby forming an upward and inward folded portion. In such exemplary aspects, a bottom edge of the garment is therefore defined by a fold crease.

In certain aspects, the upper body garment further can further comprise left and right shoulder straps or a pair of shoulder straps. In some aspects, the left and right shoulder straps are configured to extend across the wearer's left and right shoulders, respectively, and to couple the front panel with the back panel. It is understood that that pair of shoulder straps can be positioned on the wearer's back in any pattern. In some aspects, the pair of should straps extend straight across the wearer's shoulders and the back to connect with the front panel with the back panel. While in other exemplary and unlimiting aspects, the shoulder straps can form a crisscross pattern or any other pattern that provides the desired support without irritating the wearer's body or creating undesired folding and bulges in the wearer's body. While in still further aspects, the left and right shoulder straps can extend across the wearer' left and right shoulders and to couple to each other around a wearer's neck without coupling to the back panel. The front panel further comprises a breast supporting region substantially covering the wearer's breasts.

The accompanying drawings illustrate one aspect of the disclosed garment, in the form of a longline sports bra, which is configured to substantially limit movement of the wearer's breast tissue during athletic activity. The upper body garment and its components can comprise any fabric known in the art for use in athletic wear, athleisure, or undergarments, including but not limited to spandex, polyester, nylon, cotton and rayon. The upper body garment is configured to cover at least a portion of the wearer's upper body. In some aspects, the upper body garment is also configured to cover at least a portion of the wearer's abdominal and lower back areas.

Figure 2:
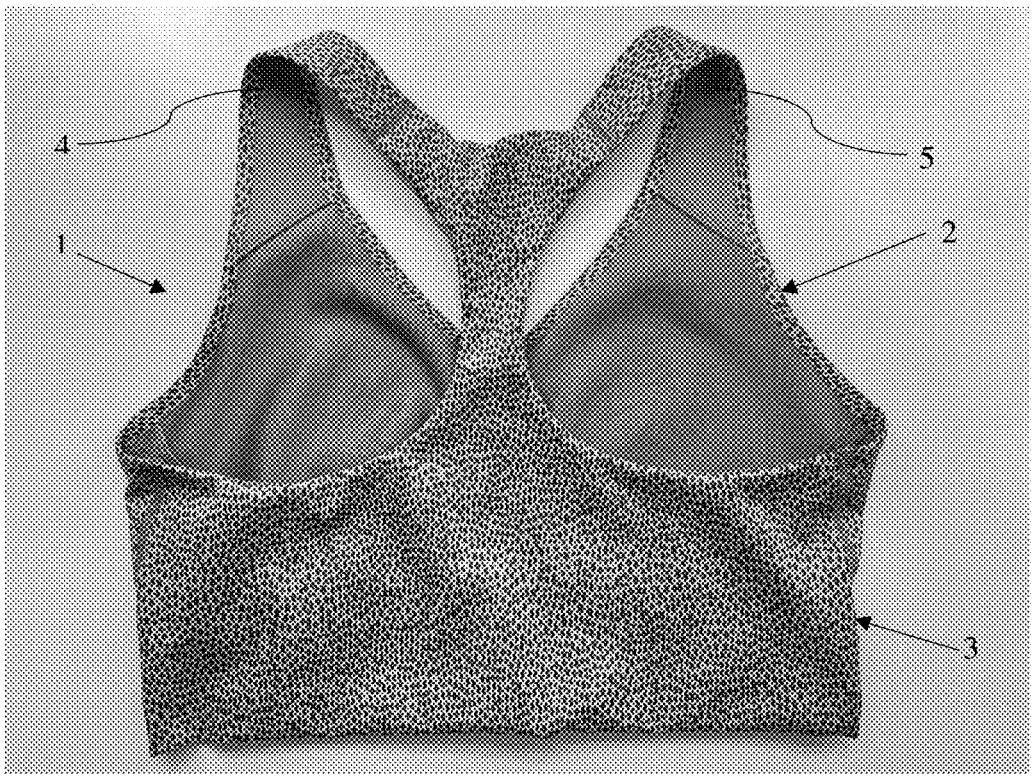
FIG. 2 illustrates a back view of the aspect of FIG. 1.
Figure 3:
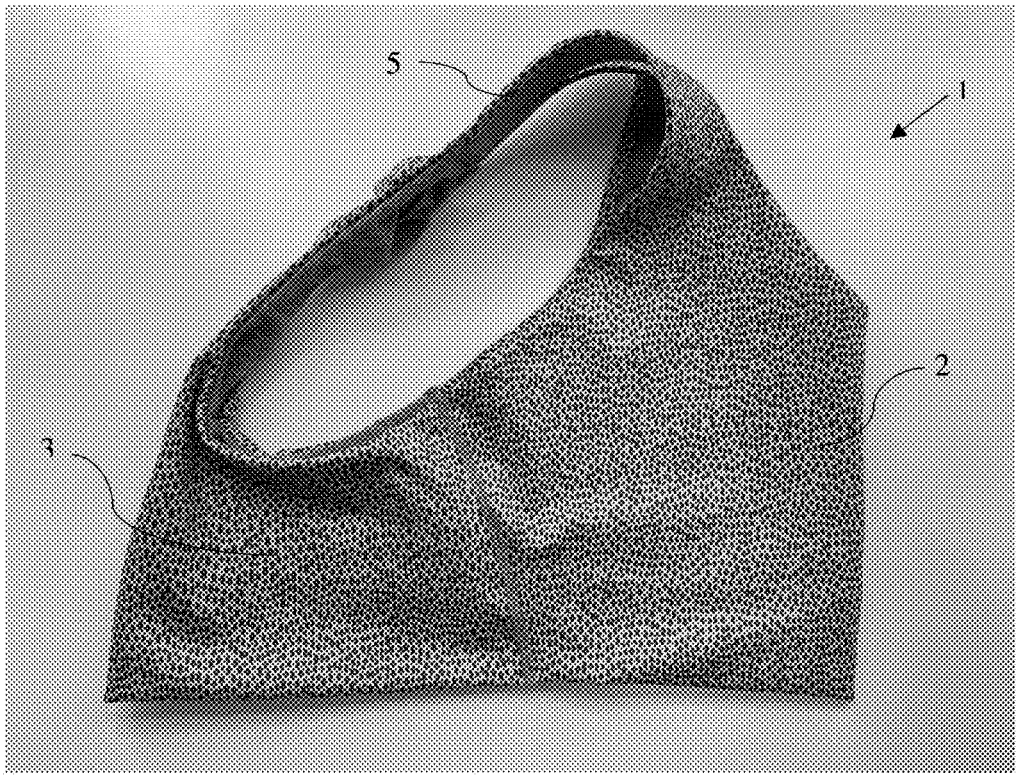
FIG. 3 illustrates a left-side view of the aspect of FIG. 1.
Figure 4:
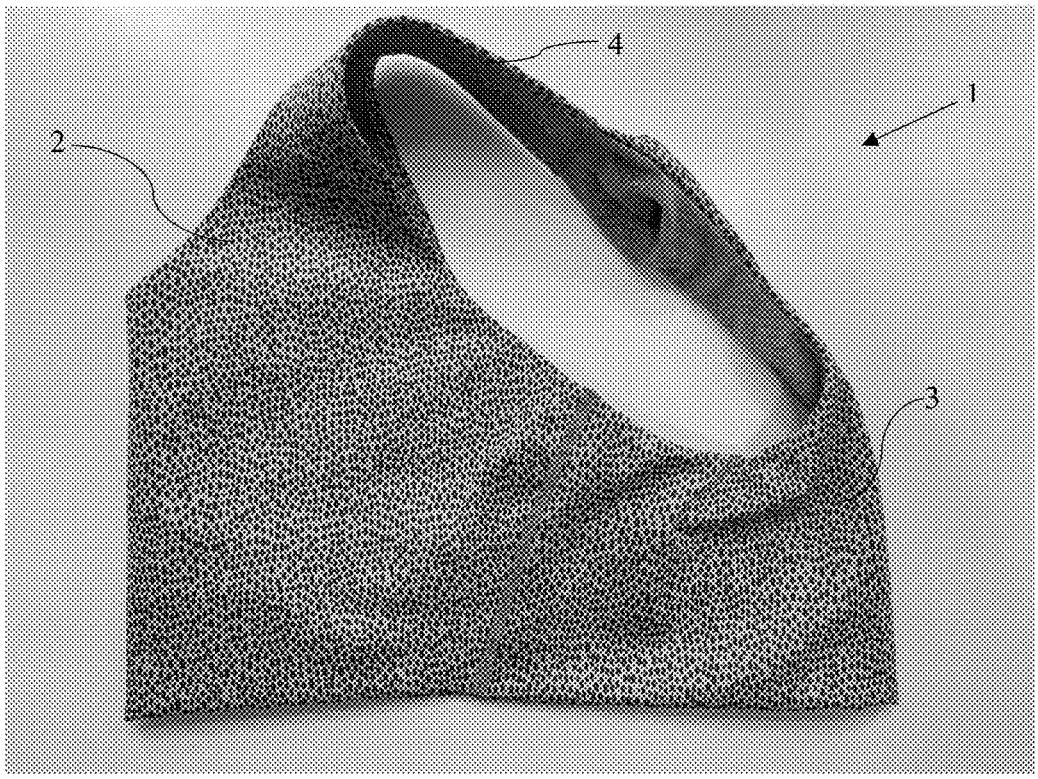
FIG. 4 illustrates a right-side view of the aspect of FIG. 1.
Figure 5:
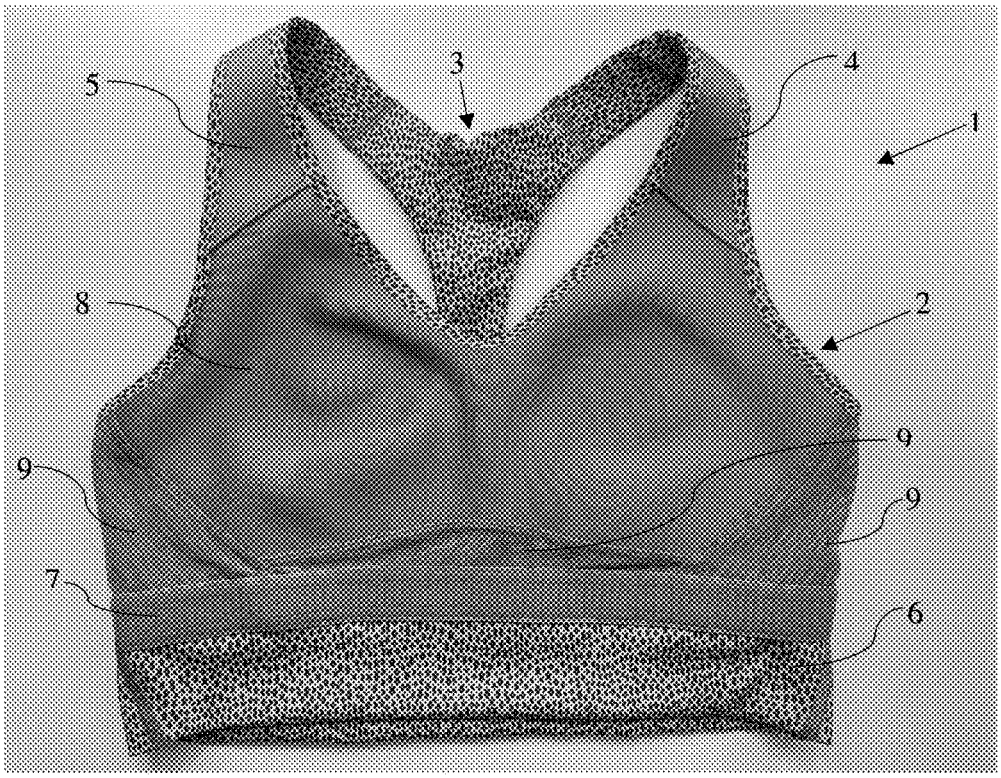
FIG. 5 illustrates an interior front view of the aspect of FIG. 1.
Figure 6:
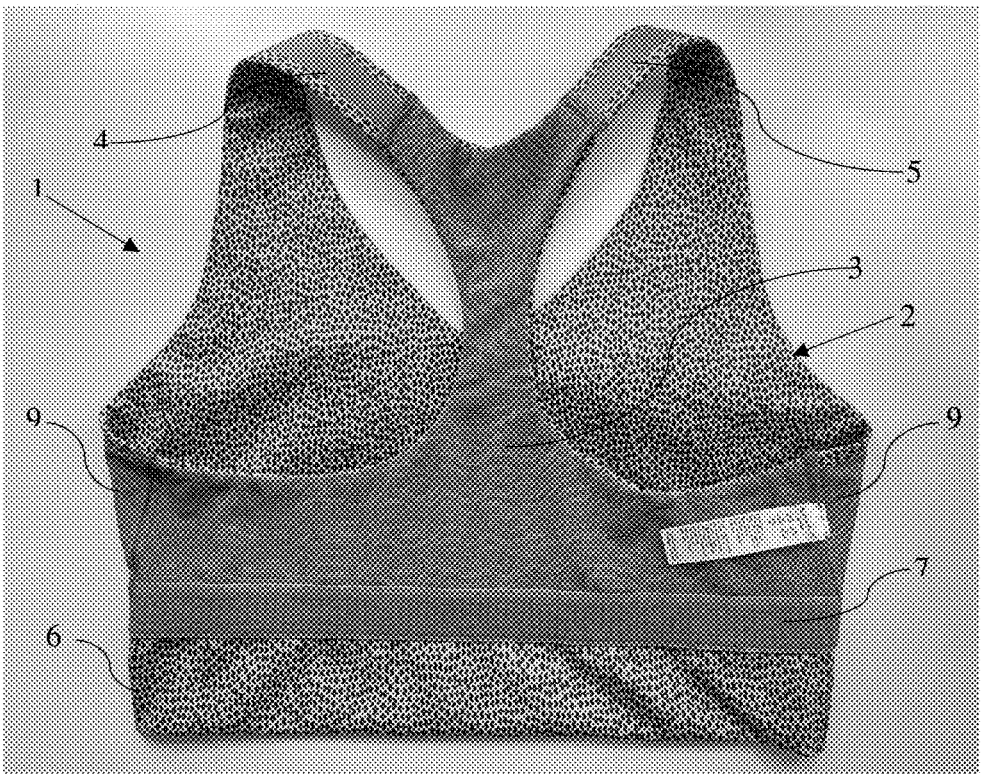
FIG. 6 illustrates an interior back view of the aspect of FIG. 1.
Figure 7:
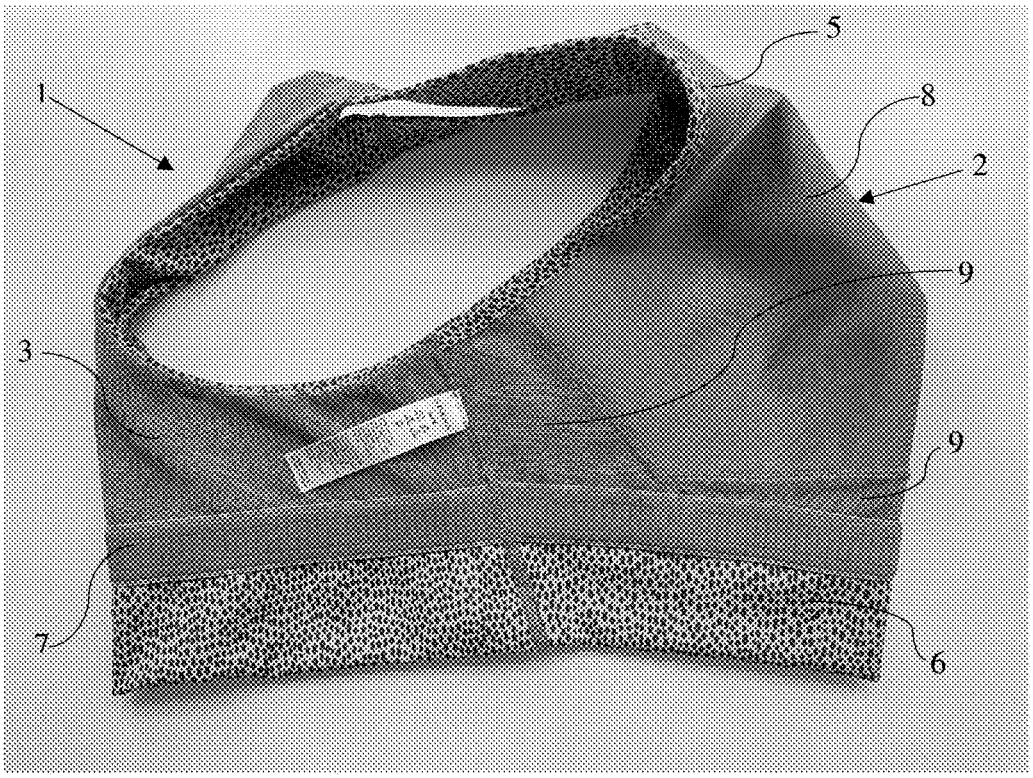
FIG. 7 illustrates an interior left-side view of the aspect of FIG. 1.
Figure 8:
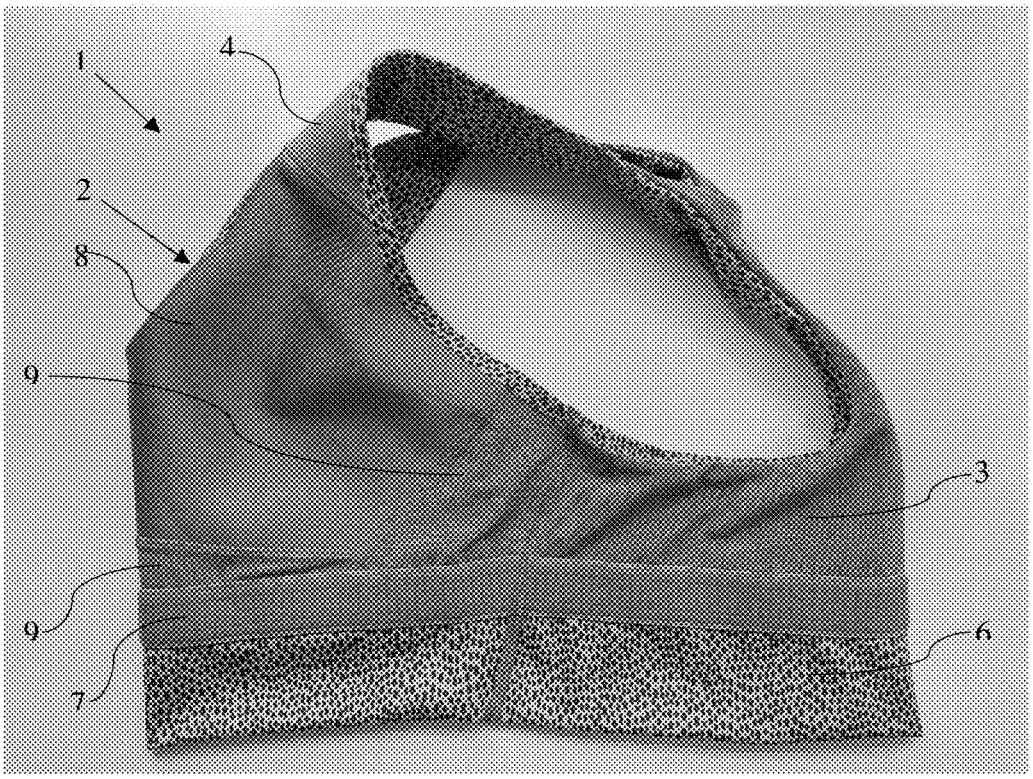
FIG. 8 illustrates an interior right-side view of the aspect of FIG. 1.

FIG. 1 illustrates a front, exterior view of one aspect of an upper body garment 1 configured to cover a portion of the wearer's thorax when in use. FIGS. 2, 3, and 4 illustrate a back, left-side, and right-side, respectively, exterior view of the aspect of FIG. 1. FIGS. 1-4 show a front panel 2 comprising a first front material, a back panel 3 comprising a first back material, and left and right shoulder straps 4, 5. FIG. 5 illustrates a front, interior view of the aspect of FIG. 1. FIGS. 6, 7, and 8 illustrate a back, left-side, and right-side, respectively, interior view of the aspect of FIG. 1. FIGS. 5-8 show the front panel 2 comprising a first front material, the back panel 3 comprising a first back material, the left and right shoulder straps 4, 5, an upward and inward folded portion 6, an elastic band 7, a breast support region 8 comprising a second material, and a third material 9.

The front and back outer layers comprise a first front material and a first back material, respectively. The first front material and first back material may be the same or different. The front and back inner layers each comprise one or more materials that may be the same or different from the first front material and/or the first back material. In certain aspects, the first material comprises any fabric useful for the desired application. In certain aspects, the first material comprises Lycra® fiber.

The upward and inward folded portion defines at least a portion of the front and back inner layers of the garment such that at least a portion of the front and back inner layers of the garment comprise the first front material and the first back material, respectively. In still further aspects, the upward and inward folded portion can have a predetermined length. It is understood that the length of the folded portion can be dependent on the desired application of the garment and is not limited to any specific number.

In certain aspects, the front inner layer further comprises a breast supporting region. The breast supporting region may be positioned to cover at least a portion or all of the wearer's breast tissue. In some aspects, the breast supporting region extends at least to a root of a wearer's breasts. In some aspects, the breast supporting region is configured to extend from the superior edge of the wearer's breast tissue to the inferior edge of the wearer's breasts. In some aspects, the breast supporting region is configured to extend from the wearer's left underarm to the wearer's right underarm. At least a portion of the breast supporting region comprises a second material. The second material is configured to substantially conform to the wearer's breast shape. In some aspects, the second material has been molded to the shape of the wearer's left and right breasts. The molding of the second material may be accomplished using conventional methods known in the art. In some aspects, the second material can comprise any fibers allowing to achieve the desired application. In some aspects, the fibers can comprise polyester, nylon, elastane, or any combination thereof. In some aspects, polyester, nylon, cotton, rayon, and/or elastane can be present in any ratio to provide for the desired level of compressibility, elasticity and stretchability. It is understood if the fiber comprises two or more polymers, these polymers can be present in any ratio that is needed to achieve the desired result. For example, if two or more polymers are present in the fiber, a first polymer can be present in the range from greater than 0 wt % to less than 100 wt %, including exemplary values of about 1 wt %, about 5 wt %, about 10 wt %, about 20 wt %, about 30 wt %, about 40 wt %, about 50 wt %, about 60 wt %, about 70 wt %, about 80 wt %, about 90 wt %, and about 99.9 wt %. In still further aspects a second polymer can also be present in any amount in the range from greater than 0 wt % to less than 100 wt %, including exemplary values of about 1 wt %, about 5 wt %, about 10 wt %, about 20 wt %, about 30 wt %, about 40 wt %, about 50 wt %, about 60 wt %, about 70 wt %, about 80 wt %, about 90 wt %, and about 99.9 wt %. In some exemplary and unlimiting aspects, the second material can comprise about 93% polyester and 7% elastane. In still further aspects, because the second material is expected to be in contact with the wearer's body, the second material comprises fibers that do not cause skin irritation, are comfortable and pleasing to touch. Without wishing to be bound by any theory, it is understood that the breast supporting region and the molded second material can provide additional support and comfortability for the wearer's breasts.

The back and front inner layers may further comprise a third material. The third material of the back inner layer may be positioned along at least a portion of the wearer's back and/or at least a portion of the wearer's underarms. The third material of the front inner layer may be positioned adjacent to the breast supporting region. The third material of the front inner layer may be positioned below the wearer's breasts and along at least a portion of the wearer's underarms. The third material may comprise a mesh-like material. The third material may further comprise multiple panels of the mesh-like material that may be cut and sewn. It is understood that the specific direction of the cut can be determined by the desired application. It is further understood that various cuts of the mesh-like material that are sewn together do not have to be cut in the same direction.

In some aspects, the front inner layer comprises a panel of the third material positioned below the wearer's breast tissue. The front inner layer may comprise a panel of the third material along at least a portion of each of the wearer's underarms. In some aspects, the front inner layer comprises a panel of the third material positioned below the wearer's breasts in addition to a panel of the third material along at least a portion of each of the wearer's underarms. In some exemplary and unlimiting aspects, the third material of the front or back inner layers can comprise any materials suitable for the desired application, including but not limited to nylon, elastane, polyester, cotton, and/or rayon. In some exemplary aspects, the third material can comprise nylon and elastane present in any desired ratio. For example, and without limitations, the third material can comprise about 75% nylon and 25% elastane. The third material comprising mesh-like material provides for breathability and wicking of sweat from the wearer's body, particularly from problem areas such as under the breast tissue, the underarms, and the back.

In further aspects, the upper body garment further comprises an elastic band circumferentially positioned on the inner surface of the garment and unreleasably affixed to at least a portion of the front and back inner layers. In certain aspects, the elastic band is substantially aligned with a lower edge of the wearer's sternum bone when in use. In some aspects, the elastic band comprises a first elastic band positioned on the front inner layer and a second elastic band positioned on the back inner layer. The first and the second elastic band may be coupled together at at least lateral edges of the front and back panels. The elastic band may comprise any elastic material known in the art. In some aspects, the elastic band further comprises a non-slip coating configured to grip the wearer's body when in use. In certain aspects, the elastic band and its positioning provide breast support and grips the body to prevent slippage of the garment when in use, particularly during high-impact movements and exercise.

The elastic band may be affixed to the third material of the front and/or back inner layers. In some aspects, an edge of the third material of the front and/or back inner layers is affixed to an edge of the elastic band. At least a portion of the elastic band may overlap with at least a portion of the third material of the front and/or back inner layers.

The upward and inward folded portion is further affixed to the elastic band. The upward and inward folded portion may be affixed to the elastic band with a seam, bonding, or other attachment method known in the art. In some aspects, an edge of the upward and inward folded portion is affixed to an edge of the elastic band. At least a portion of the elastic band may overlap with at least a portion of the upward and inward folded portion.

The configuration and positioning of the upward and inward folded portion and the elastic band provide several advantages over conventional upper body garments. The upward and inward folded portion and fold crease bottom edge, rather than a rigid edge or an edge defined by an elastic band, allows the wearer to freely move or twist the waist during exercise without restriction, irritation, or slippage of the garment. Further, where a typical rigid edge or edge defined by an elastic band would create visible bulging of the wearer's body, the upward and inward folded portion and fold crease bottom edge does not compress the wearer's body, creating and maintaining the effect of a smooth profile of the wearer's torso and is thus less visible under clothing. The upper body garment, therefore, encircles the wearer's torso such that substantially no bulging is formed in the wearer's body at the bottom edge of the garment.

The length of the upward and inward folded portion can be predetermined to allow for variations in garment length while maintaining proper support for the wearer's breast tissue. The predetermined length can be defined such that the upper body garment is a sports bra, longline sports bra, crop top, cami, tank top, or shirt. Further, the upward and inward folded portion adjusts to the wearer such that its fold crease bottom edge will be higher for a larger wearer than a smaller wearer. This allows for more fit flexibility within the constraint of alpha sizing.

The second material may be connected to the third material of the front inner layer, the elastic band, and/or the left and right shoulder straps using conventional cut and sew methods known in the art. In some aspects, at least a portion of an inferior edge of the second material is connected to at least a portion of an edge of the third material of the front inner layer. In still further aspects, at least a portion of a superior edge of the breast supporting region is affixed to the left and right shoulder straps. In some aspects, an upper portion of the breast supporting region extends into a pair of shoulder straps configured to couple the front panel with the back panel.

In some aspects, at least a portion of the superior edge of the second material is affixed to the first front material at least along an upper edge of the upper body garment. However, in some aspects, the second material is not affixed to the first front material along a main portion of the breast supporting region. Yet in still further exemplary and unlimiting aspects, neither the third material nor the elastic band are affixed to the first front material. Thus, the second material and the third material of the front inner layer are configured to independently slide against the first front material along a main portion of the breast supporting region and/or the front panel such that the garment is comfortably adjusted against the wearer's body. It is understood, however, that other aspects of the attachments of the elastic band and the second material are also envisioned. In some aspects, the second material can be affixed to the first front material in any desired portion of the garment.

In still further aspects, the left and right shoulder straps may comprise an inner shoulder layer and an outer shoulder layer. In some exemplary aspects, the inner and outer shoulder layers may be coupled at at least their edges with a seam, bonding, or other attachment method known in the art. In some aspects, the outer shoulder layer may comprise a material that is the same or different from the first front material and/or the first back material. In some exemplary and unlimiting aspects, the material of the inner shoulder layer may comprise a foam, which may be a rigid foam conventionally known in the art. In some aspects, the foam is configured to reduce the stretchability of the shoulder straps and thus has significantly less elasticity than other materials of the upper body garment. For example, while in some aspects the elastic band has relatively less elasticity than any other material in the garment, it is more elastic than the foam material of the inner shoulder layer. Without wishing to be bound by any theory, it is understood that the rigidity of the foam can allow for the distribution of the weight of the breast tissue along the shoulder straps while lifting and supporting the breast tissue. The foam also helps maintain the shape and placement of the shoulder straps during the use of the upper body garment. The foam is also smoother and more comfortable than other conventional shoulder straps.

The material of the outer shoulder layer may be the same as the first front material. In some aspects, the material of the outer shoulder layer is integrally knit or woven with the first front material or the first back material. In some aspects, the left and right shoulder straps are connected to the front and/or back panel at at least a portion of a superior edge of the front or back panel. The shoulder straps may be attached to the front and back panels with a seam, bonding, or other attachment method known in the art, or shoulder straps may be integral with the front and/or back panel.

The left and right shoulder straps and the back panel may be configured to create a Y shape (or racerback), a V shape, or a U shape. In some aspects, the left and right shoulder straps may overlap in an X shape across the wearer's back, creating a crisscross design. The front panel may be configured to create a Y shape (or racerback), a V shape, or a U shape.

In some aspects, the upper body garment comprises at least one releasable fastener mechanism configured to secure the garment on the wearer's body. In some aspects, the releasable fastener mechanism is adjustable. The releasable fastener mechanism may be a hook and loop fastener (such as VELCRO®), a zipper, a snap closure, a button closure, a hook and eye closure, a G-hook, or any other fastener known in the art.

Methods of making the upper body garments disclosed herein include forming a front panel, shoulder straps, and a back panel. The inner layer of the front panel is formed by attaching the superior and lateral edges of a breast supporting region to at least one panel of a third material. The inner layer of the back panel is formed by providing a panel of the third material. The inner layer of the front panel is then attached to inferior edges of the inner layers of shoulder straps. The back outer layer is formed by providing a material covering the outer surface of the back panel. The back outer layer is connected to the back inner layer along lateral and at least a portion of their superior edges. The front outer layer and outer shoulder layer are formed by integrally knitting or weaving a material covering the outer surface of the front panel and shoulder straps. The front outer layer is connected to the front inner layer at at least a portion of their lateral edges and a portion of their superior edges. The shoulder straps are connected to at least a portion of a superior edge of the back panel.

The front and back outer layers are circumferentially folded upward and inward onto the inner surface of the upper body garment, thereby forming an upward and inward folded portion. An elastic band is unreleasably affixed to the upward and inward folded portion and the inner layer of the front and back panels. The front panel and the back panel are connected at a portion of their lateral edges.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The implementation was chosen and described in order to best explain the principles of the invention and the practical application and to enable others of ordinary skill in the art to understand the invention for various implementations with various modifications as are suited to the particular use contemplated.

The invention claimed is:

1. An upper body garment having an inner surface and an outer surface and comprising:

a front panel comprising a breast supporting region;

a back panel configured to cover at least a portion of a wearer's back and wherein the back panel is coupled to the front panel;

wherein the front panel comprises a front inner layer and a front outer layer, and the back panel comprises a back inner layer and a back outer layer;

wherein a portion of each of the front and back outer layers circumferentially folds upward and inward onto the inner surface of the upper body garment, thereby forming an upward and inward folded portion, and further defining a fold crease at a bottom edge of the garment; and an elastic band circumferentially positioned on the inner surface of the garment at a position superior to a top edge of the upward and inward folded portion;

wherein each of the front and the back panels is configured to extend up to at least a lowest edge of the wearer's thorax; and wherein the upper body garment is configured to substantially limit movement of the wearer's breast tissue during athletic activity.

2. The upper body garment of claim 1, wherein the front outer layer and the back outer layer comprise a first front material and a first back material, respectively, wherein the first front material and the first back material are the same or different.

3. The upper body garment of claim 2, wherein the front inner layer and the back inner layer each comprises one or more materials that are the same or different from the first front material and/or the first back material.

4. The upper body garment of claim 3, wherein the upward and inward folded portion defines at least a portion of the front inner layer and the back inner layer of the garment such that at least a portion of the front and back inner layers of the garment comprises the first front material and the first back material, respectively.

5. The upper body garment of claim 2, wherein at least a portion of the front inner layer in the breast supporting region of the front panel comprises a second material that is different from the first front material or the first back material, and wherein the second material is configured to substantially conform to the wearer's breast shape.

6. The upper body garment of claim 5, wherein the second material is configured to extend at least to a root of the wearer's breast.

7. The upper body garment of claim 5, wherein the first front material and/or the first back material and the second material are affixed to each other at least along an upper edge of the garment.

8. The upper body garment of claim 5, wherein the first front material and/or first back material and the second material are not affixed to each other along a main portion of the breast supporting region, and wherein the first front material and/or first back material and second material are configured to independently slide against each other such that the garment is comfortably adjusted against the wearer's body.

9. The upper body garment of claim 8, wherein the front inner layer further comprises a third material, wherein the third material is the same or different from the first front material, the first back material, and/or the second material.

10. The upper body garment of claim 9, wherein the elastic band comprises a first elastic band positioned on the front inner layer and a second elastic band positioned on the back inner layer wherein the first and the second elastic band are coupled together at at least lateral edges of the front and back panels, and wherein the third material is disposed between the second material and the first and second elastic bands.

11. The upper body garment of claim 9, wherein the third material is disposed between each lateral edge of the breast supporting region and each lateral edge of the front panel.

12. The upper body garment of claim 1, wherein the upward and inward folded portion has a predetermined length.

13. The upper body garment of claim 1, wherein the elastic band is configured to substantially align with a lower edge of the wearer's sternum bone, and the elastic band is unreleasably affixed to at least a portion of the front inner layer and the back inner layer of the garment.

14. The upper body garment of claim 13, wherein the elastic band comprises a first elastic band positioned on the front inner layer and a second elastic band positioned on the back inner layer wherein the first and the second elastic band are coupled together at at least lateral edges of the front and back panels.

15. The upper body garment of claim 14, wherein an edge of the upward and inward folded portion is affixed to the first and second elastic bands or wherein the first and second elastic bands are not affixed to the front outer layer and/or the back outer layer.

16. The upper body garment of claim 1, wherein the garment is configured to encircle a wearer's torso such that substantially no bulging is formed in the wearer's body at the bottom edge of the garment.

17. The upper body garment of claim 1, wherein an upper portion of the breast supporting region extends into a pair of shoulder straps configured to couple the front panel with the back panel.

18. The upper body garment of claim 17, wherein the shoulder straps comprise an outer layer and an inner layer, wherein the outer layer of the shoulder straps is a continuous extension of the front outer layer, and wherein the inner layer of the shoulder straps comprises a material configured to reduce stretchability of the shoulder straps.

19. The upper body garment of claim 17, wherein an upper portion of the back panel is unreleasably or releasably coupled to distal edges of the shoulder straps.

20. The upper body garment of claim 1, wherein at least one of the front panel or the back panel comprises a releasable fastener mechanism configured to secure the garment on the wearer's body.

* * * * *